United States Patent [19]

Cohen et al.

[11] 4,077,241

[45] Mar. 7, 1978

[54] LOCKING ARRANGEMENT

[76] Inventors: M. Roy Cohen, E. Warren Rd., East Warren, Vt. 05674; Bruce W. Arrington, 296 Gifford Rd., Westport, Mass. 02790; William W. Pittendreigh, 30 Pinette St., New Bedford, Mass. 02740

[21] Appl. No.: 740,194

[22] Filed: Nov. 9, 1976

[51] Int. Cl.[2] ..... E05B 9/04

[52] U.S. Cl. ..... 70/371; 70/427

[58] Field of Search ..... 70/63, 85, 87, 371, 70/423, 427, DIG. 63; 109/59, 64, 66

[56] References Cited

U.S. PATENT DOCUMENTS

| | | | |
|---|---|---|---|
| 1,917,973 | 7/1933 | Hughes | 70/427 |
| 2,209,067 | 7/1940 | Belknap | 109/59 |
| 3,296,842 | 1/1967 | Averbach | 70/82 |
| 3,477,261 | 11/1969 | Siana | 70/427 |
| 3,871,284 | 3/1975 | Krise | 109/59 |

*Primary Examiner*—Robert L. Wolfe

*Attorney, Agent, or Firm*—Cushman, Darby & Cushman

[57] ABSTRACT

A tamper-resistant locking arrangement is provided by positioning a pair of key-actuated cylinder locks in coaxial relationship within a housing. One of the locks is adapted to be selectively removed to provide access to a key-receiving end of the other lock spaced inwardly from the end of the housing.

4 Claims, 2 Drawing Figures

LOCKING ARRANGEMENT

BACKGROUND OF THE INVENTION

A persistent problem particularly prevalent in connection with coin-operated vending machines is tampering with locks of the type conventionally employed to secure a coin box. Normally such locks are quite accessible, and therefore, they are relatively easy prey to persons skilled at lock picking.

Attempts have been made in the past to increase the difficulty in opening such locks. For example, in U.S. Pat. No. 3,296,842 which issued to William A. Auerbach and A. Kurimky on Oct. 1, 1967 and in U.S. Pat. No. 3,871,284 granted to George W. Krise on Mar. 18, 1975, the devices used to hold coin boxes in place are rendered relatively inaccessible by concealing them by removable lock members. With these members removed, special tools are employed to actuate the box-securing devices. However, a shortcoming of such prior art arrangements is that once an intruder gets past the removable lock, he can fashion a tool which will open all box securing devices of this type. Thus, while these known arrangements initially make it somewhat difficult for an unauthorized person to unlock the securing arrangement, once he has learned how to do so, further intrusions are relatively simple.

SUMMARY OF THE INVENTION

The present invention is an improvement of the basic concept employed in U.S. Pat. Nos. 3,296,842 and 3,871,284. More particularly, a housing is provided for retaining a pair of cylinder locks in coaxial relationship. Improved security is achieved since a key is required to open both the outer and inner locks. Due to the recessed nature of the inner lock, it is extremely difficult for a person to pick after the outer lock has been removed.

Figure 1:
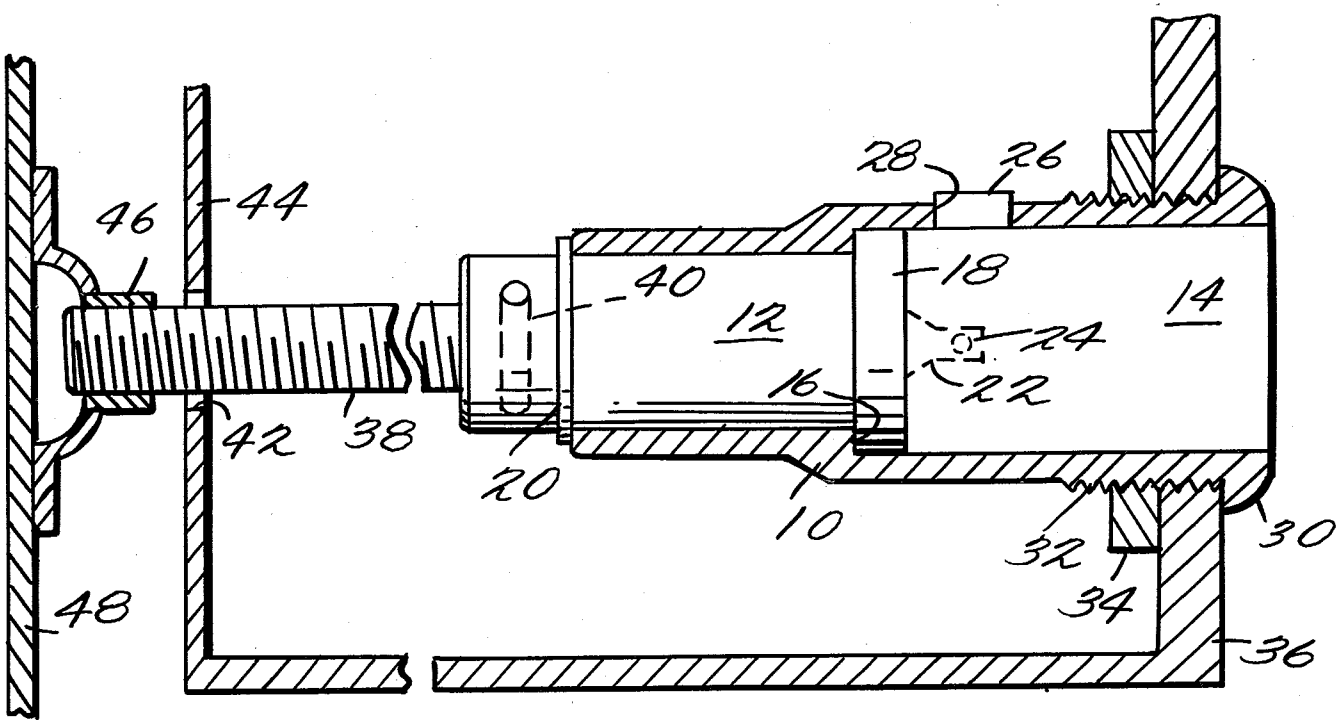
Figure 2:
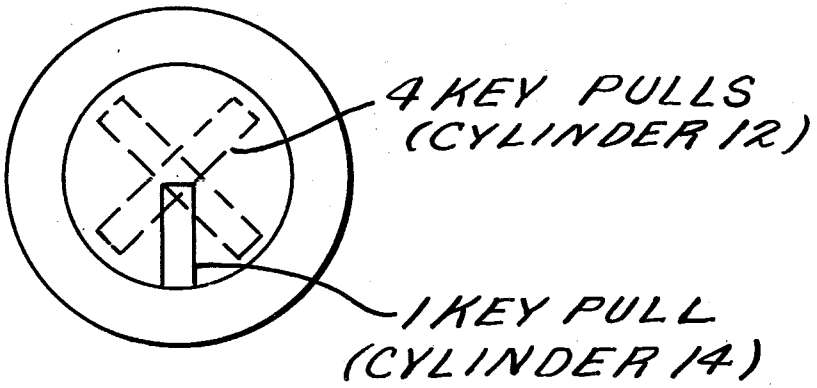

The invention now will be described in further detail with reference to the accompanying drawings, wherein:

FIG. 1 is a side elevational view, partially in section, illustrating the lock arrangement in operative relationship with a typical coin box of a vending machine; and FIG. 2 is an end view of the lock shown in FIG. 1.

DETAILS OF THE INVENTION

Referring to FIG. 1, the improved locking arrangement comprises a housing 10 having a cylindrical bore therein to receive an inner cylinder lock 12 and an outer cylinder lock 14 arranged in coaxial alignment.

The bore is provided with a shoulder 16 upon which a flanged portion 18 of inner lock 12 rests. Lock 12 projects beyond the end of housing 10 and includes an annular groove to receive a C-shaped spring 20. By virtue of the flanged portion 18 engaging shoulder 16 and the spring 20 being positioned in the annular groove, the inner lock 12 is held in fixed position with respect to housing 10.

The lock 12 is of conventional construction and is provided with a key insertion end within housing 10, the lock having a plurality of key pull positions as illustrated in FIG. 2. The purpose of plural key pulls will be described hereinafter.

The outer cylinder lock 14 is preferably of the conventional dead bolt type. When located within housing 10, the inner end of lock 14 abuts the outer surface of the flanged portion 18 of lock 12. Lock 14 is provided with a keyway 22 to receive a stud 24 projecting from the interior of the housing bore. As a result of this arrangement, the lock 14 is properly oriented within the housing so that its dead bolt portion 26 is in alignment with an aperture 28 in the housing 10. By selective operation of the dead bolt with a key inserted in its outer end, lock 14 is either retained within housing 10 or is removed therefrom to provide access to the key insertion end of inner lock 12.

Use of the locking arrangement in connection with a coin box can be appreciated with reference to FIG. 1. The outer end of housing 10 is provided with a flanged portion 30, and the housing is threaded adjacent the flange, as indicated by numeral 32, to receive a nut 34. The end wall 36 of the coin box is retained between flange 30 and the nut 34.

A threaded extension 38 is provided at the inner end of lock 12. The extension is secured to the projecting end of the lock 12 by a pin 40 passing through both the lock and extension 38. Accordingly, when lock 12 is actuated by its key, threaded portion 38 is rotated.

Portion 38 projects through a hole 42 in the coin box end wall 44 to engage a nut 46 which is supported by conventional means in spaced relationship from a portion 48 of the machine with which the coin box is associated.

In operation, with the lock 14 removed and a key inserted in lock 12, the coin box is fastened to the machine by bringing the threaded extension 38 into engagement with nut 46. The key of lock 12 is actuated to rotate extension 38, thereby drawing the box towards machine portion 48 until the end wall 36 of the coin box firmly engages a wall of the machine (not shown). The amount of key rotation necessary to achieve the desired engagement relationship is subject to variation. Therefore, in order to avoid excess force on the key which might cause it to break, the inner lock 12 is provided with a plurality of key pull positions so that the key may be withdrawn without having to rotate it a substantial degree after the coin box is firmly positioned in operative position. With the inner key removed, the outer lock 14 is secured within the housing to conceal the inner lock.

Under the conditions just described, the outer lock 14 must be removed before access can be gained to the inner lock 12. In this regard, it should be noted in FIG. 2 that the key pull of lock 14 is out of alignment with those of lock 12, thereby preventing the possibility of access to the inner key pulls via the outer one. Although the outer lock 14 can be removed relatively easily by a person skilled in picking locks, the depth of the outer surface of lock 12 within the relatively narrow bore in housing 10 makes it extremely difficult for a person to pick lock 12. Since the lock 12 can be selectively set to operate with different key arrangements, a standardized tool cannot be relied upon to actuate this lock. Accordingly, the lock arrangement just described provides improved security.

With lock 14 removed and a proper key inserted in lock 12, continued actuation of the key in a reverse direction to that employed in securing the coin box to the machine causes threaded portion 38 to disengage from nut 46, thereby releasing the coin box.

While the invention just described is particularly suitable for use with coin boxes, it will be understood that the concept is equally adaptable to use whenever it is desired to limit access to a lock so as to increase the difficulty of it being picked.

We claim:

1. An improved arrangement for locking a coin box to a vending machine comprising:

a lock housing;

a coin box secured to said housing;

a cylindrical bore within said housing;

a first key-operated cylindrical lock positioned within said bore whereby an end of the lock adapted to receive a key is spaced inwardly from the ends of said housing;

an extension projecting beyond said housing from an end of said first lock opposite the key-receiving end, said extension being adapted to be removably secured to the machine in accordance with selective actuation of said first lock by the key; and a second key-operated cylindrical lock removably positioned within said bore in coaxial relationship with the first lock to conceal the key-receiving end of said first lock.

2. A locking arrangement as set forth in claim 1, wherein each of said locks has at least one key pull position, the positions of the respective locks being out of alignment.

3. A locking arrangement as set forth in claim 2, wherein the first lock has a plurality of key pull positions.

4. A locking arrangement as set forth in claim 1, wherein said second lock is of the dead bolt type, the arrangement further comprising means for orienting the second lock with respect to an aperture in the housing for receiving the dead bolt when said second lock is actuated to thereby retain the second lock within the housing.

* * * * *